US012104512B2

(12) United States Patent
Hutschenreuther et al.

(10) Patent No.: US 12,104,512 B2
(45) Date of Patent: Oct. 1, 2024

(54) MUFFLER AND METHOD FOR MAKING THE SAME

(71) Applicant: Purem GmbH, Neunkirchen (DE)

(72) Inventors: Sebastian Hutschenreuther, Ostfildern (DE); Rolf Baldes, Freisen (DE); Thomas Beck, Aichwald (DE)

(73) Assignee: Purem GmbH, Neunkirchen (DE)

( * ) Notice: Subject to any disclaimer, the term of this patent is extended or adjusted under 35 U.S.C. 154(b) by 159 days.

(21) Appl. No.: 17/855,200

(22) Filed: Jun. 30, 2022

(65) Prior Publication Data

US 2023/0003162 A1 Jan. 5, 2023

(30) Foreign Application Priority Data

Jun. 30, 2021 (DE) ..... 10 2021 116 802.3

(51) Int. Cl.
*F01N 13/00* (2010.01)
*F01N 13/18* (2010.01)

(52) U.S. Cl.
CPC ..... *F01N 13/007* (2013.01); *F01N 13/185* (2013.01)

(58) Field of Classification Search
CPC ..... F01N 13/007; F01N 13/1838; F01N 13/1844; F01N 13/185
See application file for complete search history.

(56) References Cited

U.S. PATENT DOCUMENTS 4,233,726 A * 11/1980 Williams ..... F01N 13/185 29/523
4,570,747 A * 2/1986 Ortyl ..... F01N 13/185 181/243
4,846,302 A 7/1989 Hetherington
5,477,015 A * 12/1995 Preslicka ..... B21D 39/04 181/243
6,659,222 B1 12/2003 Allman
7,434,658 B2 * 10/2008 Staut ..... F01N 13/1872 181/271
2005/0115764 A1 * 6/2005 Mabuchi ..... F01N 13/08 181/240
2006/0096805 A1 5/2006 Staut
2007/0029135 A1 * 2/2007 Ermer ..... F01N 13/1811 181/269
2007/0227812 A1 * 10/2007 Wolf ..... F01N 1/083 181/264

(Continued)

FOREIGN PATENT DOCUMENTS

DE 800 924 C 12/1950
DE 38 10755 C1 9/1989

(Continued)

*Primary Examiner* — Jeremy A Luks
(74) *Attorney, Agent, or Firm* — Walter Ottesen, P.A.

(57) ABSTRACT

A muffler for an exhaust system of an internal combustion engine includes a muffler housing with a peripheral wall which extends longitudinally in the direction of a housing longitudinal axis. At least one base wall is surrounded by the peripheral wall or/and retained on the peripheral wall and delimits a chamber in the muffler housing. At least one base wall opening is surrounded by an opening edge region which is bent at an essentially plane base wall region of the base wall essentially in the direction of the housing longitudinal axis. The at least one base wall opening receives an exhaust pipe with a press fit in at least one base wall.

12 Claims, 4 Drawing Sheets

(56) References Cited

U.S. PATENT DOCUMENTS

| | | | | |
|---|---|---|---|---|
| 2008/0196969 | A1 | 8/2008 | Henke et al. | |
| 2011/0215573 | A1* | 9/2011 | Tanaka | F01N 13/08 29/523 |
| 2016/0281559 | A1 | 9/2016 | Gommans | |

FOREIGN PATENT DOCUMENTS

| | | | |
|---|---|---|---|
| DE | 10 2009 053 429 | A1 | 9/2011 |
| DE | 2010 015 322 | A1 | 10/2011 |
| EP | 1 888 891 | B1 | 2/2008 |

* cited by examiner

MUFFLER AND METHOD FOR MAKING THE SAME

CROSS REFERENCE TO RELATED APPLICATION

This application claims priority of German patent application no. 10 2021 116 802.3, filed Jun. 30, 2021, the entire content of which is incorporated herein by reference.

TECHNICAL FIELD

The present disclosure relates to a muffler for an exhaust system of an internal combustion engine, for example in a motor vehicle.

BACKGROUND

Such a muffler, known for example from US 2008/0196969, comprises a muffler housing with a circumferential wall and a plurality of base walls which are surrounded by the circumferential wall and are carried on the latter. Base walls of this type form respective end walls, which close off the interior of the muffler housing in the direction of a housing longitudinal axis from the outside, in the two axial end regions of the circumferential wall. Base walls of this type form respective intermediate walls, which separate chambers formed inside the muffler housing from one another, in that region of the muffler housing which is situated between the two end walls. Such chambers can be interconnected via openings provided in a respective intermediate wall but can also form a resonator chamber for a Helmholtz resonator.

In order to be able to pass an exhaust pipe, which can also provide a resonator neck for such Helmholtz resonance, through such a base wall, it is known, by forming a passage, to form an opening edge region which surrounds a base wall opening and extends from an essentially plane region of a respective base wall in the direction of an opening center axis of a respective base wall opening. This opening edge region has an essentially cylindrical structure and receives an exhaust pipe. Such base wall openings which are surrounded by a respective opening edge region are oversized with regard to their external dimensions, that is, for example the external diameter of an exhaust pipe constructed with an essentially circular cross-section, such that an exhaust pipe can be received in such a base wall opening with a small amount of play and can thus be brought into an installed position provided for it. In this position, a respective exhaust pipe is then connected, generally by welding, to the base wall through which it passes to make a firm bond.

SUMMARY

An object of the present disclosure is to provide a muffler for an exhaust system of an internal combustion engine, and a method for producing such a muffler, by which a connection can be effected between a base wall and an exhaust pipe passing through the latter which prevents the generation of noise.

According to an aspect of the present disclosure, this object is achieved by a muffler for an exhaust system of an internal combustion engine, comprising a muffler housing with a circumferential wall which extends longitudinally in the direction of a housing longitudinal axis and at least one base wall which is surrounded by the circumferential wall or/and retained on the circumferential wall and delimits a chamber in the muffler housing, wherein at least one base wall opening, which is surrounded by an opening edge region which is bent at an essentially plane base wall region of the base wall essentially in the direction of the housing longitudinal axis, and receives an exhaust pipe with a press fit, is provided in at least one base wall.

In the case of the muffler according to the disclosure, at least one exhaust pipe is retained in an assigned base wall opening by a press fit, as a result of which, on the one hand, a stable bond is achieved and, on the other hand, the creation of relative movements between the base wall and the exhaust pipe which passes through it, which can cause impact noises or rattling noises, is prevented because of constantly present bearing contact which is under pressure or pretension. Further measures for providing a firm bond are in principle not required, wherein, however, a material connection, for example a connection by welding, can be provided in addition to retention by a press fit.

In particular when it is intended to obtain a gastight closure in the region of the connection of a base wall to an exhaust pipe, for example to provide a Helmholtz resonator, it is advantageous if the opening edge region is configured so that it runs completely circumferentially about an opening center axis of the base wall opening.

In an alternative embodiment, the opening edge region can be configured so that it is interrupted circumferentially about an opening center axis of the base wall opening. For example, it can be implemented by the opening edge region comprising a plurality of opening edge region segments arranged spaced apart from another circumferentially about an opening center axis of the base wall opening.

In an embodiment which can be implemented cost-effectively and is at the same time resistant to high temperatures and aggressive constituents of exhaust gas of an internal combustion engine, the at least one base wall can be configured as a deformed sheet-metal part. In particular when it is intended that the opening edge region is closed circumferentially, in order for example also to obtain an essentially gastight closure, it is advantageous if at least one base wall has a wall thickness of no more than 1 mm, preferably no more than 0.6 mm. In this case, the base wall can also be sufficiently deformable in the region of its elastic deformability, also in the region of the closed opening edge region in order to generate the press fit when pushing or pressing the exhaust pipe into the base wall opening, to be able to receive an exhaust pipe and to be able to generate a sufficiently high contact pressure against its outer circumferential surface.

The opening edge region can have a first edge section adjoining the essentially plane base wall region in a first bending region and a second edge section adjoining the first edge section in a second bending region, wherein a radial spacing of the first edge section from an opening center axis of the base wall opening decreases preferably essentially constantly in the direction from the first bending region to the second bending region. The region of the minimum spacing of the opening edge region from the opening center axis can then be provided in the region of the second bending region.

A radial spacing of the second edge section from the opening center axis can be essentially constant in a direction away from the second bending region such that an essentially cylindrical region is formed in which a flat bearing contact is formed between the opening edge region and the exhaust pipe. A material connection, that is, for example a welded connection, between the base wall and the exhaust pipe, can, for example, be produced at an end side of this cylindrical section.

In an embodiment which assists in particular the easy pressing of the exhaust pipe into a base wall opening which receives it and which prevents the occurrence of jamming when an exhaust pipe is pushed into a base wall opening, a radial spacing of the second edge section from the opening center axis can increase preferably essentially constantly in the direction away from the second bending region.

It can furthermore be provided that the opening edge region runs in bent form from a first axial end region, adjoining the essentially plane region of the base wall, of the opening edge region to an axial region of the opening edge region with a minimum spacing from an opening center axis of the base wall opening.

Furthermore, if the opening edge region here runs in bent form from the region of the opening edge region with a minimum spacing from the opening center axis of the base wall opening to a second axial end region, remote from the essentially plane region of the base wall, of the opening edge region, the whole opening edge region can be provided, for example, as a deforming region, with an approximately constant radius of curvature in the axial direction, of the base wall.

The at least one base wall can be an intermediate wall separating two chambers in the muffler housing from each other. Alternatively, the at least one base wall can be an end wall arranged at an axial end region of the circumferential wall. It should be pointed out that of course one or more intermediate walls and one or both end walls can be configured in a muffler as a base wall with the above described structure. It should furthermore be pointed out that it is also possible for a plurality of base wall openings, one or possibly several or all of which can have the above described structure for receiving a respective exhaust pipe with a press fit, to be formed in one or more such base walls.

According to a further aspect, the object stated at the beginning is achieved by a method for producing a muffler for an exhaust system of an internal combustion engine, in particular of a muffler constructed according to the disclosure, including the steps:

a) Providing at least one base wall for a muffler housing in such a way that at least one base wall opening formed in the base wall is surrounded by an opening edge region bent away from an essentially plane base wall region essentially in the direction of an opening center axis in such a way that the base wall opening has a predetermined internal dimension, preferably an internal diameter, b) Providing an exhaust pipe, to be received in the base wall opening surrounded by the opening edge region, with a predetermined external dimension, preferably an external diameter, wherein the predetermined external dimension of the exhaust pipe is greater than the predetermined internal dimension of the base wall opening, c) Introducing the exhaust pipe into the base wall opening surrounded by the opening edge region in such a way that the exhaust pipe is retained in the base wall opening surrounded by the opening edge region by a press fit.

It should be pointed out that the dimensions which need to be provided so that they are specifically harmonized with each other need to be considered in those regions which interact with each other when the muffler is assembled.

This means that the exhaust pipe is oversized, in the region in which it traverses a base wall when the muffler is assembled, compared with the base wall opening formed to receive this exhaust pipe in the base wall, but in other longitudinal regions it can have, for example, a smaller dimension in cross-section, or possibly an even larger dimension in cross-section, than this base wall opening.

It should furthermore be pointed out that, in the case of a muffler constructed according to the disclosure or the method to be performed according to the disclosure, such a base wall opening and an exhaust pipe to be received therein are preferably in each case formed with a circular cross-section such that the internal dimension can be represented, for example, by the internal diameter and the external dimension can be represented, for example, by the external diameter.

In step a), the opening edge region can be provided so that it runs completely circumferentially about the opening center axis. Alternatively, it can be provided that, in step a), the opening edge region is provided so that it is interrupted in at least one circumferential region. The opening edge region can, for example, be configured here with a plurality of opening edge region segments arranged spaced apart from one another circumferentially about the opening center axis.

In step a), the opening edge region can be provided, starting from the essentially plane region of the base wall, with a spacing from the opening center axis which decreases as far as an axial region of the opening edge region with a minimum spacing from the opening center axis.

Furthermore, in step a), the opening edge region can be provided with an essentially constant spacing from the opening center axis from the region of the opening edge region with a minimum spacing from the opening center axis as far as a free axial end region of the opening edge region. Alternatively, in step a), the opening edge region can be provided with a spacing from the opening center axis which increases from the region of the opening edge region with a minimum spacing from the opening center axis as far as the free axial end region of the opening edge region.

In order, on the one hand, to enable the introduction of an exhaust pipe into a base wall opening and, on the other hand, to obtain a sufficiently firm press fit, it is proposed that a difference between the predetermined external dimension of the exhaust pipe and the predetermined internal dimension of the base wall opening provided to receive the exhaust pipe is in the range from 0.2 mm to 0.6 mm, preferably is approximately 0.4 mm. For this purpose, it can furthermore be provided that, in step a), the at least one base wall is provided as a deformed sheet-metal part or/and with a wall thickness of no more than 1 mm, preferably no more than 0.6 mm.

Moreover, in order to obtain a stable bond, a step d) can be provided for connecting the exhaust pipe to the opening edge region by a material connection, preferably welding.

BRIEF DESCRIPTION OF THE DRAWINGS

The invention will now be described with reference to the drawings wherein.

DESCRIPTION OF THE PREFERRED EMBODIMENTS

Figure 1:
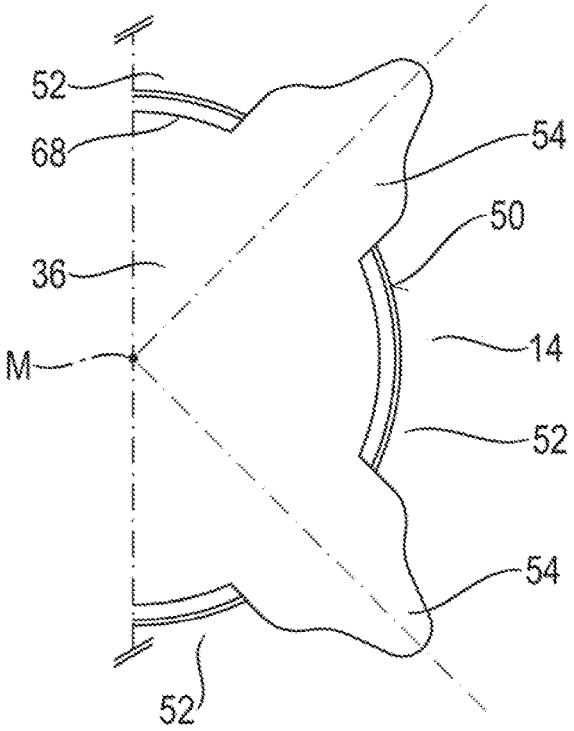
FIG. 1 shows a partial axial view of a base wall for a muffler in the region of a base wall opening.

Before different embodiments and details of embodiments of a base wall of a muffler for an exhaust system of an internal combustion engine, for example in a vehicle, are explained below with reference to FIGS. 1 to 6, an example of a fundamental structure of a muffler 10, which includes a total of four base walls 12, 14, 16, 18 in the example illustrated, is first explained with reference to FIG. 7. A muffler housing 20 of the muffler 10 moreover includes a circumferential wall 22 which extends longitudinally in the direction of a housing longitudinal axis L, is for example essentially cylindrical, and is connected to the radially outer region of the base walls 12, 14, 16, 18 or surrounds the latter.

The base walls 12, 18 arranged on the axial end regions 24, 26 of the circumferential wall 22 form respective end walls of the muffler housing 20 which close off the interior of the muffler at the two axial ends. The base walls 12, 18 can be connected firmly and gas tightly in their radially outer region to the circumferential wall 22 by a material connection, for example welding. Alternatively or additionally, the base walls 12, 18 providing respective end walls can be firmly and gas tightly connected to the circumferential wall 22 in the axial end regions 24, 26 by a form fit, for example by flanging.

The base walls 14, 16 arranged between the base walls 12, 18 providing the two end walls form respective intermediate walls which, together or in conjunction with the base walls 12, 18 providing end walls, divide the interior of the muffler into a total of three chambers 28, 30, 32. The base walls 14, 16 providing intermediate walls can be retained in a defined position, for example on the inner circumference of the circumferential wall 22, by clamping or/and a material connection, for example welding.

In the example illustrated, the base walls 12, 14, 16, 18 each have, in a central region, a base wall opening 34, 36, 38, 40 explained in more detail below with regard to its structure. The base wall openings 34, 36 of the base walls 12, 14 are traversed by an exhaust pipe 42 which can form, for example, an inlet pipe via which exhaust gas is fed into the interior of the muffler. The base wall openings 38, 40 of the base walls 16, 18 are traversed by an exhaust pipe 44 which can provide, for example, an outlet pipe via which exhaust gas is conducted away from the muffler 10.

The exhaust pipe 42 can, for example, be open to the chamber 28 formed between the two base walls 12, 14 and, in an axial end region of the latter, can be open to the chamber formed between the two base walls 14, 16. The chamber 28 can be connected to the chamber 30 via one or more flow-through openings formed in the base wall 14. The chamber 32 can form a resonator chamber of a Helmholtz resonator and be connected to the chamber 30 via an exhaust pipe 46 provided in the base wall 16 and providing a resonator neck.

It is noted that the structure described above with reference to FIG. 7 of a muffler is only an example and this structure can be varied in a wide range of aspects. This can relate to the number and positioning of the base walls provided or the muffler and likewise to the number of exhaust pipes feeding exhaust gas into the muffler or exhaust pipes conveying exhaust gas away from the muffler. It is also possible for the guidance of the exhaust gas inside the muffler to be implemented in a different manner to that in the example illustrated.

The embodiment of a base wall provided in the muffler 10 is described in detail below with reference to FIGS. 1 to 6 in that region in which an exhaust pipe traverses a base wall opening. It is noted that such an embodiment, as described below, can be implemented for each of the base walls provided in a muffler 10, that is, in the example illustrated for each of the base walls 12, 14, 16, 18, where a respective exhaust pipe 42 or 44 traverses the latter. Such a configuration, as described below, could also be provided in association with the exhaust pipe 46 providing a resonator neck. It is of course possible that differently shaped base wall openings are also provided in a base wall in order to guide an exhaust pipe through them, and that not all of the base wall openings provided in one or various base walls must have the structure described below.

The structure of such a base wall is described below, for example, with reference to the base wall 14 which forms an intermediate wall and separates two chambers 28, 30 which are connected to each other to exchange exhaust gas in the interior of the muffler.

Figure 2:
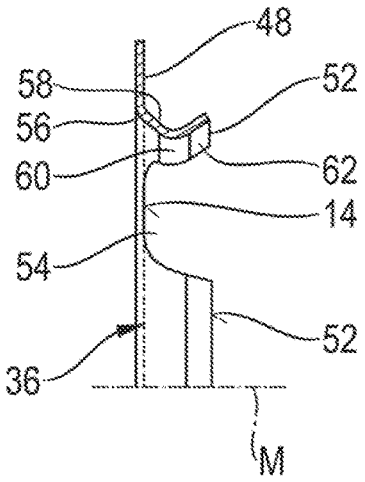
FIG. 2 shows a partial axial view in section of the base wall of FIG. 1.
Figure 3:
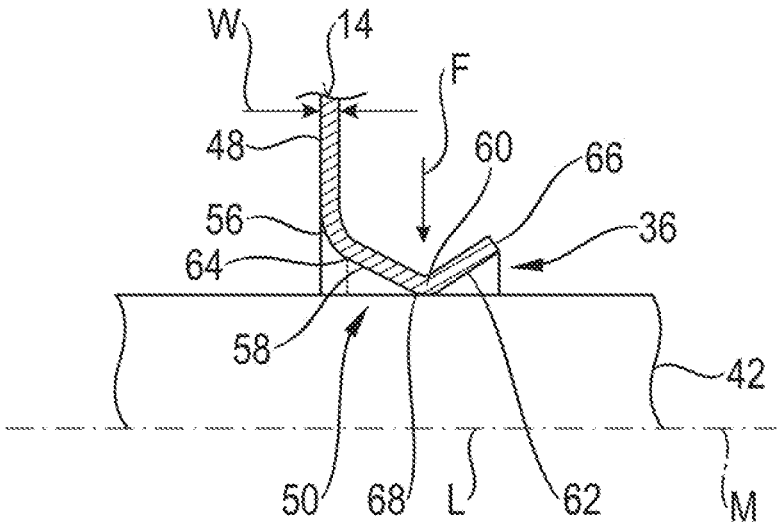
FIG. 3 shows a partial view of the base wall of FIGS. 1 and 2 in the region of the base wall opening traversed by an exhaust pipe.

FIGS. 1 to 3 show that region of the base wall 14 in which the base wall opening 36 provided therein is traversed by the exhaust pipe 42. In this region, at the base wall 14, an opening edge region 50 formed, for example as a passage, by a base wall region 48, which is essentially plane and is oriented essentially orthogonally to the housing longitudinal axis L, of the base wall 14 is bent away in the direction of the housing longitudinal axis L corresponding in the embodiment illustrated to an opening center axis M. For this purpose, the base wall 14 constructed with sheet-metal material is formed by corresponding tools in the region of the base wall opening 36. It should be pointed out that an edge region bent away in the direction of the housing longitudinal axis L can also be formed in the radially outer region, that is, where the base wall 14 is retained on the circumferential wall 22.

In the embodiment of the base wall 14, which separates two chambers 28, 30 which are connected to each other to exchange exhaust gas, the opening edge region 50 can be interrupted circumferentially and, for example, be constructed with four opening edge region segments 52 following one another circumferentially and arranged with a circumferential spacing from one another, between which respective circumferential cutouts 54, via which the two chambers 28, 30 separated from each other by the base wall 14 can be connected to each other to exchange exhaust gas, are formed in the base wall 14 or the essentially plane base wall region 48.

If it is intended to provide a gastight closure by such a base wall, as is the case for example in connection with the base walls 12, 18 providing end walls or alternatively the base wall 16 providing an intermediate wall, the opening edge region 50 can be configured as an opening edge region so that it runs completely circumferentially about a respective opening center axis M of the respective base wall opening 34, 40 or 38 and is not interrupted circumferentially.

In the embodiment of FIGS. 1 to 3, the opening edge region 50 has a first edge section 58 adjoining the essentially plane base wall region 48 in a first bending region 56. The first edge section 58 has a structure which tapers essentially conically or frustoconically with respect to the opening center axis M, starting from the first bending region 56, such that, starting from the first bending region 56, the spacing of the first edge section 58 from the opening center axis M decreases essentially constantly. This means that the first edge section 58, viewed in an axial direction, is essentially not curved and of course has, for example, a circularly curved structure about the opening center axis M. A second edge section 62 adjoins the first edge section 58 in a second bending region 60. The second edge section 62 similarly has a conical or frustoconical structure such that its radial spacing from the opening center axis M increases essentially constantly starting from the second bending region 60. The opening edge region 50 thus has a structure which is essentially V-shaped in longitudinal section between a first axial end region 64 adjoining the essentially plane base wall region 48 in the region of the first bending region 56 and a second axial end region 66, remote from the base wall region 48, of the latter.

Where the two edge sections 58, 62 adjoin each other, that is, essentially in the region of the second bending region 60, the opening edge region 50 has a minimum spacing from the opening center axis M of the base wall opening 36. In the situation illustrated in FIG. 5, in which the exhaust pipe 42 does not yet traverse the base wall 14 or the base wall opening 36 formed therein, this minimum spacing corresponds to a predetermined internal dimension a which, in particular in an essentially circular embodiment of the base wall opening 36, can represent the radius of the base wall opening 36 with respect to the opening center axis M or the internal diameter, that is, twice the radius.

The exhaust pipe 42 is dimensioned in such a way that its predetermined external dimension A, for example also represented by the radius or twice the radius, that is, the diameter, of the exhaust pipe 42 configured, for example, with a circular cross-section is greater than the corresponding predetermined internal dimension a of the base wall opening 36. For example, the external dimension A, that is, the diameter, corresponding to twice the radius R, of the exhaust pipe 42, can be formed so that it is oversized within a range of 0.2 mm to 0.6 mm, preferably approximately 0.4 mm, with respect to the corresponding internal dimension a, that is, for example the internal diameter of the base wall opening 36.

When the muffler 10 is assembled, after the base wall 14 has been provided with the form provided therefor and possibly surrounded by the circumferential wall 22, the exhaust pipe 42 is introduced into the base wall opening 36 in the direction of the opening center axis M or the housing longitudinal axis L. Because the exhaust pipe 42 is oversized with respect to the base wall opening 36 receiving the latter, when the exhaust pipe 42 is introduced, the opening edge region 50 is spread out radially somewhat such that the exhaust pipe 42 is retained in the base wall opening 36 by a press fit and hence by a force fit. The opening edge region 50 which is spread out radially in the region of its elastic deformability, or its opening edge region segments 52, press radially inward against the outer circumference of the exhaust pipe 42 with a force F such that, on the one hand, the exhaust pipe 42 is retained in a defined position with respect to the base wall 14 and, on the other hand, a defined bearing contact on the exhaust pipe 42 is generated by the opening edge region segments 52 pressing against the outer circumference of the exhaust pipe 42 with the force F such that the occurrence of rattling noises can be prevented.

By virtue of the embodiment of the opening edge region 50 with its two edge sections 58, 62 which provide essentially a V-shaped contour of the opening edge region 50, an introduction slope, which enables the exhaust pipe 42 to be introduced easily into the base wall opening 36 and prevents it getting caught because of sharp-edged bearing contact, is formed for the exhaust pipe 42 to be received in the base wall opening 36.

It is also possible in the case of an embodiment of the opening edge region 50 with an uninterrupted form in the circumferential direction, that is, as a circumferentially continuous opening edge region, for the latter to be spread out radially when the exhaust pipe 42 is introduced into the base wall opening 36. In the case of a circumferentially closed structure of the opening edge region 50, it is advantageous if the base wall 14 is provided with a relatively low wall thickness W of no more than 1 mm, preferably no more than 0.6 mm. In the case of such a thin-walled configuration of the base wall 14, it is ensured that, when the exhaust pipe 42 is introduced into the base wall opening 36, the circumferentially closed opening edge region 50 is correspondingly spread out because the exhaust pipe 42 is slightly oversized and, because of its elasticity, the force F which then acts radially inward essentially uniformly over the whole circumference is exerted on the exhaust pipe 42.

Figure 4:
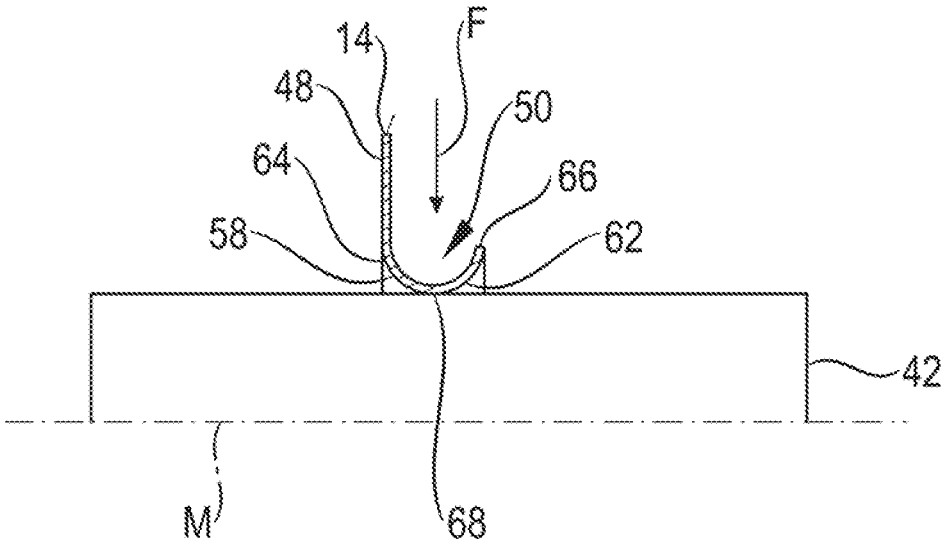
FIG. 4 shows a schematic diagram, corresponding to FIG. 3, of an alternative embodiment.
Figure 5:
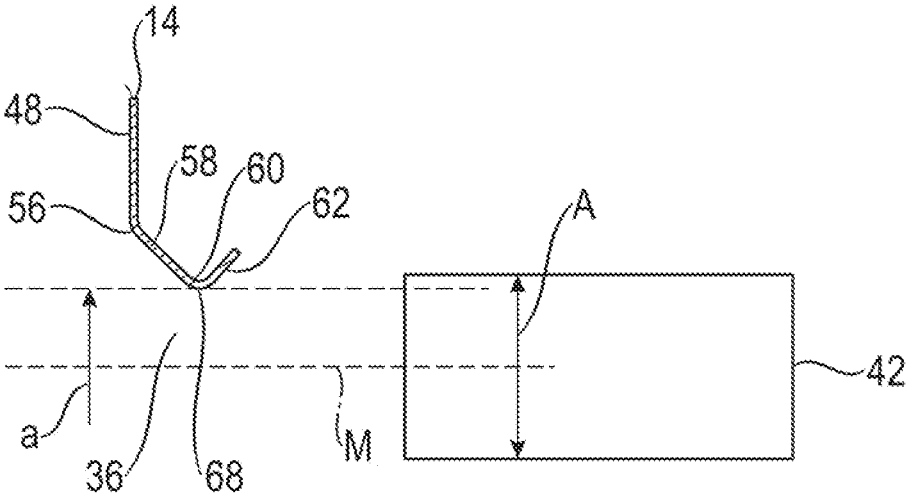
FIG. 5 shows a further schematic diagram, corresponding to FIG. 3, to explain the size ratios.

An alternative embodiment of the base wall 14 is illustrated in FIG. 4. The opening edge region 50 is configured in this embodiment too with two edge sections 58, 62. The edge section 58 adjoins the essentially plane base wall region 48 in the axial end region 64 of the opening edge region 50, whilst the edge section 62 provides the second axial end region 66 remote from the base wall region 48. Both edge sections 58, 62 are configured so that they are curved in the axial direction and have a considerably larger radius of curvature than, for example, the two bending regions 56, 60 of the embodiment illustrated in FIG. 3. For example, an essentially constant radius of curvature as far as the region 68 with the minimum diameter of the opening edge region 50 could be provided in each of the edge sections 58, 62, and the radii of curvature in the two edge sections 58, 62 could, for example, be the same as each other but of course could also be configured to be different. For example, the radius of curvature in the radial section 62 could be smaller than the radius of curvature in the edge section 58.

In the embodiment illustrated in FIG. 4 too, the opening edge region 50 could be closed circumferentially, as is required, for example, in the region of the base walls 12, 18 providing respective end walls in order to obtain a gastight closure, but it could alternatively also be provided with the above described circumferentially segmented embodiment on the one hand to provide increased flexibility in the region of the base wall opening, and on the other hand to enable gas to pass through the base wall opening in this region.

Figure 6:
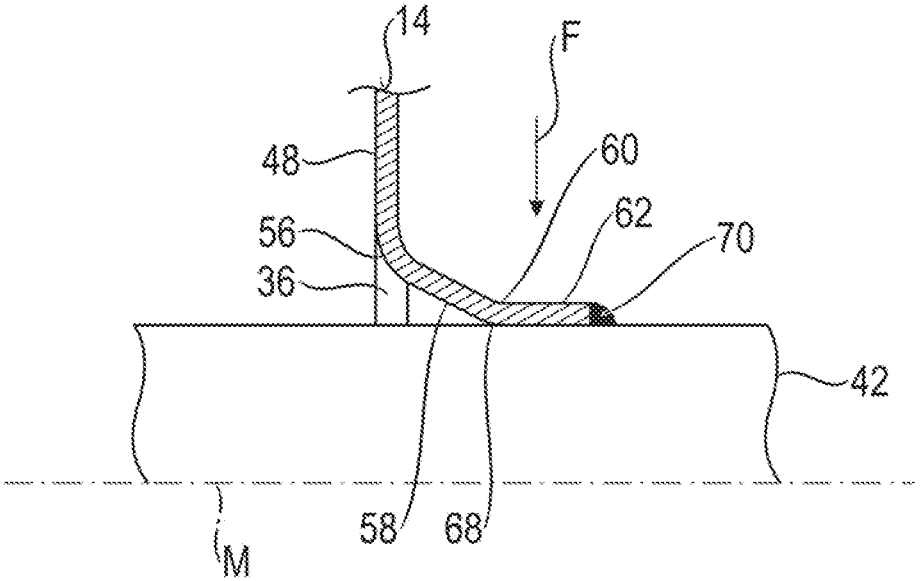
FIG. 6 shows a further diagram, corresponding to FIG. 3, of an alternative embodiment; and, FIG. 7 shows a schematic diagram in longitudinal section of a muffler comprising a plurality of base walls.
Figure 7:
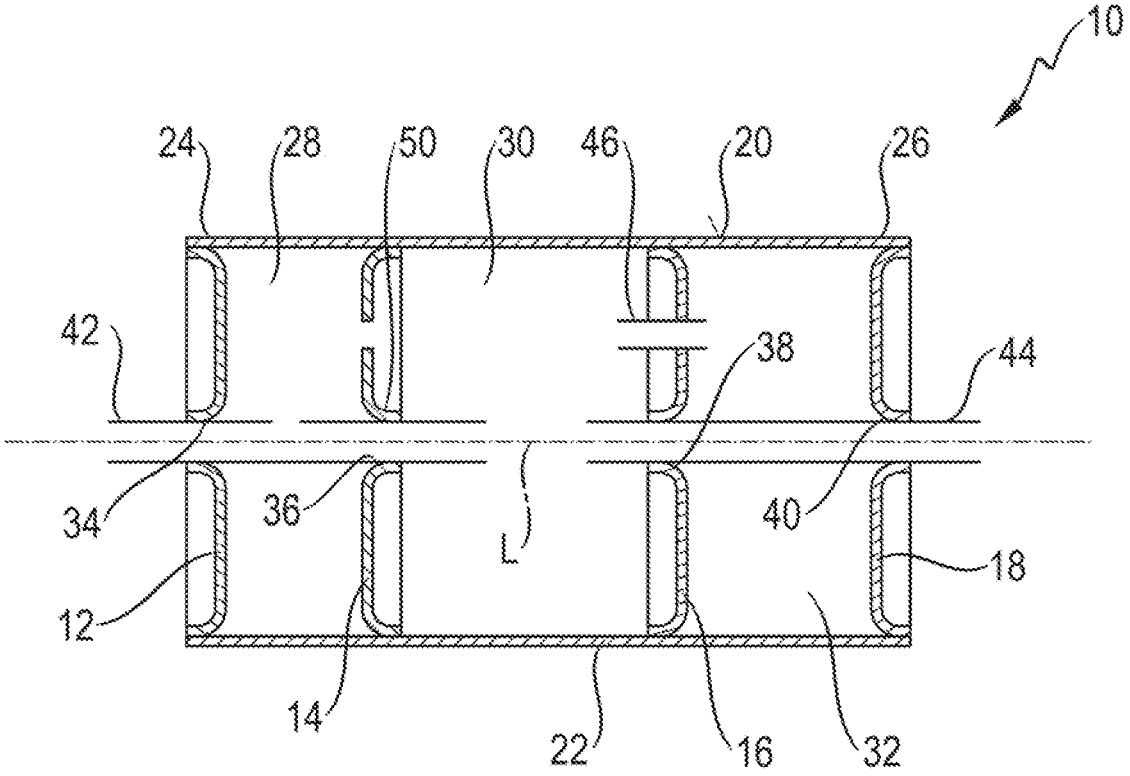

A further alternative embodiment is illustrated in FIG. 6. In this embodiment, the opening edge region 50 again has the two edge sections 58, 62 which adjoin the essentially plane base wall region 48 or each other. The edge section 58 has, for example, the conical or frustoconical structure which can also be seen in FIG. 3 with an essentially constant decrease in the spacing from the opening center axis M between the two bending regions 56, 60. The second edge section 62 has an essentially cylindrical structure and thus has an essentially constant spacing from the opening center axis M between the second bending region 60 and the second axial end region 66 such that the minimum spacing from the opening center axis M is provided between the second bending region 60 and the second axial end region 66. In this embodiment, an essentially flat bearing region, extended axially and therefore further, is provided between the opening edge region 50 and the exhaust pipe 42. This is suitable for providing, in addition to the press fit generated by the radially inward exerted force F, a firm connection between the base wall 14 and the exhaust pipe 42 by a material connection, for example by a circumferentially peripheral weld seam 70 which can be configured as a fillet seam between an essentially axially oriented end surface of the second edge section 62 and the outer circumferential surface of the exhaust pipe 42.

In the embodiment illustrated in FIG. 6 too, the opening edge region 50 can be configured so that it runs circumferentially, that is, uninterrupted, or can be provided as an opening edge region interrupted circumferentially at least at one point, for example as an opening edge region with a plurality of opening edge region segments following one another circumferentially.

It should finally be pointed out again that the structure, described above with reference to FIGS. 1 to 6, of a base wall opening or of an opening edge region surrounding the latter can be provided for each base wall traversed by an exhaust pipe, wherein base wall openings or opening edge regions provided in different base walls can of course also be provided with different structures. It can, for example, be chosen depending on what diameter an exhaust pipe traversing a respective base wall has or on whether it is intended to obtain a gastight closure in the region of a base wall opening traversed by an exhaust pipe or it is intended that the passage of exhaust gas is possible.

In each of the above described embodiments of a base wall, it is possible to push an exhaust pipe easily by hand or using a machine through a respective base wall and introduce it into a base wall opening provided to receive an exhaust pipe, wherein the respective opening edge region is spread out and the force fit required to generate the press fit is created. When a muffler constructed in this way is operating, the different components of the latter heat up and expand such that the press fit or the force exerted on an assigned exhaust pipe by a respective opening edge region increases and an even stronger retaining effect is generated.

It is understood that the foregoing description is that of the preferred embodiments of the invention and that various changes and modifications may be made thereto without departing from the spirit and scope of the invention as defined in the appended claims.

What is claimed is:

1. A muffler for an exhaust gas system of an internal combustion engine, the muffler comprising:

a muffler housing defining a housing longitudinal axis (L);

said muffler housing having a peripheral wall extending longitudinally in the direction of said longitudinal axis (L);

at least one base wall delimiting a chamber in said muffler housing and defining a planar base wall region;

said base wall being arranged in said muffler housing via at least one of the following: by being surrounded by said peripheral wall and by being held by said peripheral wall;

said at least one base wall having a base wall opening formed therein surrounded by an opening edge region;

said opening edge region being bent at said planar base wall region in the direction of said housing longitudinal axis (L); and, an exhaust gas pipe received in said base wall opening with a press fit in said at least one base wall, wherein:

said base wall opening defines an opening center axis (M);

said opening edge region has a first edge section adjoining said planar base wall region in a first bending region;

said opening edge region has a second edge section adjoining said first edge section in a second bending region;

a radial spacing of said first edge section from said opening center axis (M) decreases constantly in a direction from said first bending region to said second bending region, and a radial spacing of said second edge section from said opening center axis (M) increases constantly in a direction away from said second bending region.

2. The muffler of claim 1, wherein said base wall opening defines an opening center axis (M); and, said opening edge region is configured to run completely peripherally about said opening center axis (M).

3. The muffler of claim 1, wherein said base wall opening defines an opening center axis (M); and, said opening edge region is configured so as to be interrupted in a peripheral direction about said opening center axis (M).

4. The muffler of claim 3, wherein said opening edge region includes a plurality of opening edge region segments arranged mutually spaced apart peripherally about said opening center axis (M).

5. The muffler of claim 1, wherein at least one of the following applies:

a) said at least one base wall is configured as a deformed sheet metal part; and, b) said at least one base wall has wall thickness (W) of one of the following:

i) no more than 1 mm; and, ii) no more than 0.6 mm.

6. The muffler of claim 1, wherein said at least one base wall is an intermediate wall mutually separating two chambers in the muffler housing.

7. The muffler of claim 1, wherein said at least one base wall is an end wall arranged at an axial end region of said peripheral wall.

8. A method for making a muffler for an exhaust system of an internal combustion engine, the muffler including a muffler housing defining a housing longitudinal axis (L); the muffler housing having a peripheral wall extending longitudinally in the direction of said longitudinal axis (L); at least one base wall delimiting a chamber in said muffler housing and defining a planar base wall region; the base wall being arranged in said muffler housing via at least one of the following: by being surrounded by said peripheral wall and by being held by said peripheral wall; the at least one base wall having a base wall opening formed therein surrounded by an opening edge region; the opening edge region being bent at said planar base wall region in the direction of said housing longitudinal axis (L); and, an exhaust gas pipe received in said base wall opening with a press fit in said at least one base wall, the method comprising the steps of:

a) providing the at least one base wall for the muffler housing in such a way that the at least one base wall opening formed in the base wall is surrounded by the opening edge region bent away from the planar base wall region in the direction of an opening center axis (M) in such a way that the base wall opening has a predetermined internal dimension (a);

b) providing the exhaust gas pipe, to be received in the base wall opening surrounded by the opening edge region, with a predetermined external dimension (A), wherein the predetermined external dimension (A) of the exhaust gas pipe is greater than the predetermined internal dimension (a) of the base wall opening; and, c) introducing the exhaust gas pipe into the base wall opening surrounded by the opening edge region in such a way that the exhaust gas pipe is retained in the base wall opening surrounded by the opening edge region by a press fit, wherein, in step a):

the opening edge region is provided, starting from the planar base wall region, with a spacing from the opening center axis (M) which decreases constantly as far as an axial region of the opening edge region with a minimum spacing from the opening center axis (M); and the opening edge region is provided with a spacing from the opening center axis (M) which increases constantly from the region of the opening edge region with a minimum spacing from the opening center axis (M) as far as the free axial end region of the opening edge region.

9. The method of claim 8, wherein one of the following applies:

i) in step a), the opening edge region is provided so that it runs completely peripherally about the opening center axis (M);

ii) in step a), the opening edge region is provided so that it is interrupted in at least one peripheral region; and, iii) in step a), the opening edge region is provided so that it is interrupted in at least one peripheral region with a plurality of opening edge region segments arranged spaced apart from one another peripherally about the opening center axis (M).

10. The method of claim 8, wherein at least one of the following applies:

i) a difference between the predetermined external dimension (A) of the exhaust gas pipe and the predetermined internal dimension (a) of the base wall opening provided to receive the exhaust pipe lies in the range from 0.2 mm to 0.6 mm;

ii) a difference between the predetermined external dimension (A) of the exhaust gas pipe and the predetermined internal dimension (a) of the base wall opening provided to receive the exhaust pipe is approximately 0.4 mm; and, iii) in step a), the at least one base wall is provided as a deformed sheet-metal part with a wall thickness (W) of one of the following: no more than 1 mm; and, no more than 0.6 mm.

11. The method of claim 8, wherein a step d) is provided for connecting the exhaust pipe to the opening edge region by a material connection.

12. The method of claim 11, wherein the material connection is provided by welding.

* * * * *